US008988213B2

(12) United States Patent
Leutenegger et al.

(10) Patent No.: US 8,988,213 B2
(45) Date of Patent: Mar. 24, 2015

(54) SAFETY DEVICE, CLOSING DEVICE AND EVALUATION UNIT

(75) Inventors: Tobias Leutenegger, Chur (CH); Steven Freedman, Minneapolis, MN (US)

(73) Assignee: Cedes AG, Landquart (CH)

( * ) Notice: Subject to any disclaimer, the term of this patent is extended or adjusted under 35 U.S.C. 154(b) by 252 days.

(21) Appl. No.: 13/284,005

(22) Filed: Oct. 28, 2011

(65) Prior Publication Data

US 2013/0106601 A1 May 2, 2013

(30) Foreign Application Priority Data

Oct. 28, 2011 (EP) ..... 11008656

(51) Int. Cl.

| | |
|---|---|
| ***G08B 1/00*** | (2006.01) |
| ***E06B 9/88*** | (2006.01) |
| *G08B 23/00* | (2006.01) |
| *G08B 13/18* | (2006.01) |
| *H01J 40/14* | (2006.01) |
| *E06B 3/00* | (2006.01) |
| *E06B 9/68* | (2006.01) |
| *E05F 15/00* | (2006.01) |

(52) U.S. Cl.

CPC ..... *E06B 9/88* (2013.01); *E06B 2009/6827* (2013.01); *E06B 2009/6836* (2013.01); *E05F 2015/0052* (2013.01)

USPC ..... 340/532; 340/500; 340/556; 250/222.1; 49/506

(58) Field of Classification Search

USPC ..... 340/500, 532, 556; 49/506; 250/221

See application file for complete search history.

(56) References Cited

U.S. PATENT DOCUMENTS

| | | | | |
|---|---|---|---|---|
| 5,233,185 | A * | 8/1993 | Whitaker | 250/222.1 |
| 5,583,405 | A * | 12/1996 | Sai et al. | 318/286 |
| 6,218,940 | B1 * | 4/2001 | Rejc et al. | 340/556 |
| 6,547,042 | B1 * | 4/2003 | Collins | 187/317 |
| 7,468,676 | B2 * | 12/2008 | Styers et al. | 340/686.1 |
| 7,986,220 | B2 * | 7/2011 | Kiyomasa et al. | 340/286.02 |

(Continued)

FOREIGN PATENT DOCUMENTS

| | | |
|---|---|---|
| DE | 299 01 664 U1 | 4/1999 |
| DE | 20 2006 002 000 U1 | 4/2006 |

(Continued)

OTHER PUBLICATIONS

European Search Report dated Jan. 17, 2012.

(Continued)

*Primary Examiner* — Jennifer Mehmood
*Assistant Examiner* — Omar Casillashernandez
(74) *Attorney, Agent, or Firm* — Burr & Brown, PLLC

(57) ABSTRACT

A safety device for safeguarding a movable, guided movement element against undesired collisions with an object situated on a movement path of the movement element, said device comprising at least two sensors for detecting the object and the movement element and for outputting signals depending on the detection, and also having an evaluation unit for evaluating signals of the sensors and for generating a switch-off signal on the basis of the evaluation. For improved recognition of a risk of collision, the evaluation unit is designed to acquire from the at least two sensors a currently detected state vector from a set of state vectors which unambiguously comprise all possible combinations of the signals of the sensors, and to generate the switch-off signal in the case of predetermined state vectors.

17 Claims, 4 Drawing Sheets

(56) References Cited

U.S. PATENT DOCUMENTS

| | | | | |
|---|---|---|---|---|
| 2008/0208560 | A1 * | 8/2008 | Johnson et al. | 703/22 |
| 2010/0236729 | A1 | 9/2010 | Fischer | |
| 2011/0271602 | A1 | 11/2011 | Bartole | |

FOREIGN PATENT DOCUMENTS

| | | | | |
|---|---|---|---|---|
| DE | 102005003794 | * | 10/2007 | E05F 15/00 |
| DE | 10 2007 050 334 | A1 | 4/2009 | |
| EP | 0 789 182 | A1 | 8/1997 | |
| EP | 0 902 157 | A2 | 3/1999 | |
| EP | 1 841 942 | B1 | 1/2009 | |
| EP | 2 236 732 | A2 | 10/2010 | |
| EP | 2 374 985 | A2 | 10/2011 | |

OTHER PUBLICATIONS

European Examination Report dated Jan. 25, 2012.
Notice of Opposition, European Application No. 11008656.8, dated Sep. 25, 2014 (28 pages).

* cited by examiner

| | | I | | II | |
|---|---|---|---|---|---|
| n | $X_n$ | Status | $X_n$ | Status | $X_n$ |
| | | | | | |
| 1 | 1 | – – – | 1 | – – – | 1 |
| 2 | 2 | – – – | 2 | – – – | 2 |
| 3 | 4 | – – – | 4 | – – – | 4 |
| 4 | 8 | ○ | 0 | ○ | 0 |
| 5 | 16 | ○ | 0 | – – – | 16 |
| 6 | 32 | ○ | 0 | ○ | 0 |
| | | | | | |
| Σ | | | 7 | | 23 |

Fig. 2

| t-1 | | t | | | | | |
|---|---|---|---|---|---|---|---|
| | | I | | II | | III | |
| Status | $X_n$ | Status | $X_n$ | Status | $X_n$ | Status | $X_n$ |
| | | | | | | | |
| – – – | 1 | – – – | 1 | – – – | 1 | – – – | 1 |
| – – – | 2 | – – – | 2 | – – – | 2 | ○ | 0 |
| – – – | 4 | – – – | 4 | – – – | 4 | – – – | 4 |
| ○ | 0 | – – – | 8 | ○ | 0 | – – – | 8 |
| ○ | 0 | ○ | 0 | – – – | 16 | ○ | 0 |
| ○ | 0 | ○ | 0 | ○ | 0 | ○ | 0 |
| | | | | | | | |
| $\Sigma = 7$ | | $\Sigma = 15$ | | $\Sigma = 23>15$ | | $\Sigma = 13<15$ | |

Fig. 3

| t | 1 | 2 | 3 | 4 | 5 | 6 | 7 | 8 |
|---|---|---|---|---|---|---|---|---|
| 1 | ○ | – – – | – – – | – – – | – – – | ○ | ○ | ○ |
| 2 | ○ | ○ | – – – | – – – | – – – | – – – | ○ | ○ |
| 4 | ○ | ○ | ○ | – – – | – – – | – – – | – – – | ○ |
| 8 | ○ | ○ | ○ | ○ | – – – | – – – | – – – | – – – |
| 16 | ○ | ○ | ○ | ○ | ○ | – – – | – – – | – – – |
| 32 | ○ | ○ | ○ | ○ | ○ | ○ | ○ | – – – |
| 64 | ○ | ○ | ○ | ○ | ○ | ○ | ○ | – – – |
| 128 | ○ | ○ | ○ | ○ | ○ | ○ | ○ | ○ |
| Σ | 0 | 1 | 3 | 7 | 15 | 30 | 60 | 120 |

Fig. 4

SAFETY DEVICE, CLOSING DEVICE AND EVALUATION UNIT

FIELD OF THE INVENTION

The invention relates to a safety device for safeguarding a movable, guided movement element against undesired collisions, a closing device, and an evaluation unit.

BACKGROUND OF THE INVENTION

A device for safeguarding a driven movement element is known from the prior art, for example from EP 1 841 942 B 1. In the case of the device, an electronic unit determines, from the time difference from the first to the second light barrier as a result of the triggering of these light barriers, a time at which a downstream, third light barrier would be registered, and switches the third light barrier into the measurement state in a timely fashion before this event occurs.

The problem addressed by the invention is to propose a safety device and a closing device which make it possible in an improved manner to recognize a risk of collision during the movement of the movement element.

SUMMARY OF THE INVENTION

Advantageous embodiments and development of the invention are possible by virtue of the measures mentioned hereinafter.

The safety device according to the invention for safeguarding a movable, guided movement element against undesired collisions with an object situated on a movement path of the movement element comprises at least two sensors for detecting the object or the movement element and for outputting signals in a manner dependent on the detection. Furthermore, the safety device according to the invention comprises an evaluation unit for evaluating signals of the sensors and for generating a switch-off signal on the basis of the evaluation.

In particular, gates or doors, membrane doors, swing doors, rolling doors, telescopic doors or the like come into consideration as movement element. The movement element can, if appropriate, also include parts of a closing device which are concomitantly moved during the movement of the movement element.

In principle, the safety device according to the invention serves for avoiding undesired collisions during the movement of the movement element. If the movement element, for instance a gate, is closed, it can happen, for example, that a person, an article or some other object enters the movement space of the movement element. Without any safety device, in principle in such a case the object could be caught or trapped by the movement element. Such accidents are intended to be able to be avoided.

The evaluation unit of the safety device according to the invention acquires signals of the sensors and evaluates them, e.g. by means of corresponding electronics. This acquisition can be effected in the simplest manner by the evaluation unit being connected or wired to the respective outputs of the sensors. The sensors serve, in principle, for detecting an object, that is to say an article or a person entering the movement space of the movement element. The movement space is either the space which the movement element passes through directly during the movement of the movement element, or a region which is situated in direct proximity to this zone through which the movement element passes, and thus constitutes as it were a hazard region. An article which is therefore situated in this hazard region can, for example on account of its spatial extent, possibly bring about a collision with the movement element. In general, this movement space or at least part of this movement space is monitored by the safety device or the sensors, such that the risk of a collision can be reduced or even completely ruled out.

The sensors are additionally arranged or designed such that the movement element can be detected. The sensors can be fitted for example in the guide rail in which the corresponding movement element is guided and moved. It is furthermore conceivable for the light barriers to be arranged in a manner laterally offset with respect to the guide rail, e.g. arranged parallel to the guide rail. Occasionally, the movement element is designed or arranged such that it is registered by the sensors during its guided movement by virtue of the fact that, for example, the movement element penetrates into the detection region of the sensor. Inter alia, this can be utilized e.g. for determining the position of the movement element or of one section of the movement element by means of the sensors.

The sensors are furthermore designed to output signals which, inter alia, carry at least the information of whether or not the sensor detects an object, a person or the like. In the case of a simple light barrier, the signal can accordingly carry the information of whether or not the light barrier is interrupted. The corresponding signals are transferred to the evaluation unit, or registered by the latter.

In this case, the safety device according to the invention affords a particularly advantageous measure by virtue of the fact that, as soon as the sensor detects something, it is possible to distinguish whether an object is involved and, if appropriate, there is a risk of collision or whether the movement element itself is involved, which was registered by the sensor during its movement.

The invention utilizes the insight that the distinction between movement element and object which could bring about a collision can be found by the steady-state analysis of the signal state even without consideration of a temporal profile. For this purpose, those signal images which corresponding to the detection of an object can be defined beforehand. The ascertainment of whether an object has been detected is then effected by comparison with the defined signal images.

Accordingly, the safety device according to the invention is distinguished by the fact that the evaluation unit is designed to acquire from the at least two sensors a currently detected state vector from a set of state vectors which unambiguously comprise all possible combinations of the signals of the sensors, and to generate the switch-off signal in the case of predetermined state vectors.

Within the meaning of the invention, a state vector comprises individual items of information or information contents of the signals of the sensors. The state vector is designed such that these items of information or information contents can be assigned to the individual sensors. The items of information or information contents can comprise, in particular, the information of whether or not the sensor detects something (an object/a person or the movement element). By way of example, the totality of the signals of all the outputs of the sensors can be regarded as a state vector. In the simplest case, the information consists of a digital signal, i.e. 0 or 1; if e.g. a voltage is present at the output of the sensor, something is detected by sensor, and vice versa.

The state vector can be designed in a variety of ways. Firstly, it is conceivable that a storage unit, e.g. a register bank, is provided, wherein a corresponding sensor can be assigned to each register. It is also conceivable that only electrical lines are present, which can respectively be assigned to a sensor. The items of information, both about the detection of the sensor and about what sensor is involved, can also be present in a coded fashion in some other way, for instance by means of a numerical code, by means of different numerical values being assigned to specific sensors having specific states. By means of the assignment as to which sensor has supplied which signal or which item of information, it is then also known where the sensor is arranged or what position it has.

The evaluation unit acquires the state vector, i.e. in the simplest case the outputs of the sensors are connected to the evaluation unit. The set of all possible state vectors therefore unambiguously comprises all possible combinations of the signals of the sensors. From the state vector it is possible in particular unambiguously to identify or derive which sensor detects or does not detect something.

The state vectors can be acquired repeatedly, for example periodically, but in principle also continuously. The currently detected state vector is the state vector used to determine whether or not there is a risk of collision actually now or in a certain current period of time.

The safety device according to the invention comprises sensors which can register both the movement element and an object. The evaluation unit only evaluates the items of information from the state vector as to whether or not an article was detected by a sensor and which sensor is respectively involved. Each individual item of information of an individual sensor taken by itself only includes the information of whether or not something is detected, in principle, by the respective sensor. This individual item of information does not yet permit the conclusion of whether the detected article is the movement element or an object which could bring about a collision. However, this conclusion can be drawn from the totality of these items of information of all the signals. The movement element will, for example, during its movement, successively cover one sensor after the other and therefore be detected in each case by these sensors. During the movement of the movement element, therefore, a characteristic "pattern" is generated as to which sensors detect something and which do not. If the signals of the sensors deviate from these possible patterns, then an object has regularly penetrated into the movement space and there is a risk of collision; the evaluation unit then generates a switch-off signal. Accordingly, all the state vectors are known, in principle, which mean that either nothing is detected or the movement element is detected or an object is detected with a risk of collision. In the case of the corresponding predetermined state vectors, the switch-off signal is consequently generated.

In general, different cases of evaluation are conceivable. The signals of the sensors can be evaluated for example by a logic circuit or by a multiplexer, particularly when digital values are available as signals. The decision as to whether a switch-off signal is generated, i.e. whether a predetermined state vector is present, can be taken either by specific, fixedly predefined output lines of the logic circuit or of the multiplexer being addressed. However, it is also conceivable, in principle, for the predetermined state vectors to be kept ready for comparison. By way of example, the state vectors can also be present as numerical values which are buffer-stored in a register, wherein the predetermined state vectors are stored in a further memory and a comparison is then performed. A digital comparison by logic switching elements is also conceivable.

The safety device according to the invention is advantageously usable not only in the dynamic case, that is to say during the movement of the movement element, but also in the static case, for example if the gate is switched on again, wherein the gate can be completely extended, completely retracted or in an intermediate state.

The safety device is, in particular, scarcely susceptible to faults and makes possible a particularly high degree of safety, since the actual sensor state is always checked specifically. Moreover, sensors do not have to be activated or deactivated.

The safety device according to the invention furthermore has the advantage that practically no structural changes have to be made to a corresponding closing device on a gate etc., e.g. with the aim of fitting specific reflection tabs. Therefore, it allows particularly good retrofittability.

In one embodiment of the invention, a detected state vector can also be stored at least temporarily in order to be used for a later comparison with the current state vector. Buffer-storage in a register, other use of flip-flop circuits or the like is conceivable. This measure is also advantageous when, during the movement of the movement element, for example, a state vector is present and it is therefore known which state vector should be present next. Therefore, the safety and reliability of the device can be increased again by this measure. If appropriate, for example in the case of a gate in which a so-called "blowout" is possible (e.g. in the case of a membrane door), it is possible to distinguish even more reliably between a blowout case and a risk of collision by an object.

Furthermore, the time during the movement of the movement element can also be recorded by a timer. On the basis of this information it is possible to conclude e.g. which state vector should actually be present. It is furthermore conceivable to select, on the basis of this time, individual predetermined state vectors which can be used for a comparison or for the decision as to whether the switch-off signal is generated. As a result, for instance in the case of a telescopic door, safety can be increased since, in the case of such a door, after a specific time, the door elements can swing out and are no longer detected by the sensors. In principle, this case can also be utilized for a blowout detection, since, in the case of a "blowout", the movement element partly leaves the guide and is no longer detected at this location for example.

In one development of the invention, the evaluation unit is designed to assign, by means of a bijective mapping, unambiguously exactly one item of state information from a predetermined target set to each state vector from a set of state vectors which comprise the signals of the respective sensors individually depending on the position thereof, and to generate the switch-off signal in the case of predetermined items of state information.

By means of the evaluation unit, exactly one item of state information is unambiguously assigned to each state vector. The state information can be a specific signal, for example. An electrical or optical signal can be involved, for example. However, the state information can also consist of a numerical value. The target set consists of all possible or appropriate items of state information which can be assigned to the state vectors. Each possible item of state information is an element of the target set. The target set comprises no elements which cannot be assigned to a state vector. Accordingly, the set of the state vectors can in turn have as many elements as there are conceivable states of the sensors.

By way of example, if a safety device comprises n light barriers (n: natural number, n>0) which in each case output 0 or 1 (non-interrupted or interrupted) as signals, then the set of all possible state vectors comprises $2^n$ (2 raised to the power of n) elements. The target set then likewise comprises $2^n$ (2 raised to the power of n) elements.

This mapping is bijective, that is to say that it is both injective and surjective. Injectivity means that no value of the target set is assigned to a plurality of elements of the from the set of the state vectors. Surjectivity in turn means that each value of the target set is also assigned to an element of the plurality of elements from the set of state vectors. Mathematically this means that an inverse function also exists. That is to say that from the information of which item of state information (element of the target set) is actually present, it can be deduced one-to-one which state vector, i.e. which combination of signals from which sensors was input into the evaluation unit.

There are various conceivable possibilities as to how such a bijective mapping can be carried out in the evaluation unit.

Inter alia, it is conceivable for the evaluation unit to comprise a multiplexer which has a plurality of inputs and, depending on which inputs are addressed or signals are received, addresses different outputs or outputs signals via different outputs. The associated inputs of the multiplexer together then correspond to the state vector.

Thus, a logic circuit is also conceivable, which takes up the states of the individual sensors via assigned signal inputs and logically combines them such that a corresponding control signal, in particular a switch-off signal is output only in the case of predefined signal patterns.

On the basis of the state information finally obtained by means of the bijective mapping, a further assignment is unambiguously possible. In principle, all items of state information which can be output are known. Some of them are predetermined for the case of regular operation, and others for the case where there is a disturbance or a risk of collision. During regular operation, that is to say that the movement element is moved without, in the meantime, an object penetrating into the movement space or some other disturbance being present, certain predetermined items of state information occur. If a different item of state information is output, then regular operation is not present: the movement element should be stopped.

In one advantageous embodiment of the invention, the evaluation unit is designed to assign to the sensors in each case a numerical value depending on the position thereof and on the signal thereof and to assemble the state vector from these numerical values. By way of example, a microcontroller or a processor can also be used as evaluation unit. The corresponding mathematical operation can be carried out by means of simple programming of the microcontroller or processor.

The signals are used to carry out a mathematical operation which leads to a single numerical value or result value. The mathematical operation constitutes a bijective mapping. The set of all possible combinations of signals of all light barriers which can therefore influence the evaluation unit forms as it were the domain of definition of the mapping. Each element of the domain of definition is assigned an element of the target set by the mathematical operation (that is to say the mapping). All numerical values thus obtained which are assigned to state vectors by the bijective mapping together form the target set.

Since the result value therefore constitutes as it were a coding of which sensor detects something and which does not, from this information it is also possible to derive whether the object or the movement element is detected. If only the movement element was detected, then during movement of the movement element said movement can be continued since, in principle, no risk of collision need be feared. However, if exclusively or additionally an object is detected, then said risk of collision should actually be feared and the movement of the movement element should be stopped.

In one embodiment of the invention, an addition can be provided, for example, as mathematical operation. Such a mathematical function is generally made available by most commercially available processes/microcontrollers. Moreover, such a microcontroller or processor enables rapid signal processing.

In order to generate a switch-off signal, in one preferred development of the invention, the predetermined items of state information can be stored as comparison numbers in a comparison table which are stored in a storage unit such as a register bank or an EEPROM (electrically erasable programmable read-only memory). The numerical values/result values are subsequently compared with the comparison numbers. If the result values involve one of the comparison values, then e.g. a regular case is present, otherwise a switch-off signal is generated. In principle, it is also conceivable conversely to store only comparison values which correspond to non-regular operation, such that a switch-off signal is generated upon correspondence.

The evaluation of the result value can be effected not only by predefining a comparison table and carrying out a numerical comparison but also by programming in some other mathematical operation (e.g. a mathematical function, logic gates (AND, OR, NAND, NOR or combinations thereof) or the like, such that, when corresponding result values are present, the movement can be continued or stopped. Such electronic components such as microcontrollers, furthermore also corresponding storage elements and registers can be procured generally in a cost-effective manner. The storage requirement for a corresponding comparison table will regularly also be so small that the memories or registers of a commercially available microcontroller are entirely sufficient for these purposes. Therefore, cost-effective production can also be made possible. In an advantageous manner, such a microcontroller can, if appropriate, also be reprogrammed in a simple manner if, by way of example, additional sensors are intended subsequently to be incorporated.

It is furthermore conceivable firstly to assign the numerical value zero to each sensor if the sensor detects nothing, e.g. the light barrier is not interrupted.

The evaluation unit can carry out for example, the assignment of numerical values inter alia in a manner dependent on the respective sensor. In one development of the invention, this assignment can be effected, in particular, in such a way that, depending on the position of the individual sensors, in principle other numbers are assigned. By way of example, there are a total of N sensors present (where $n \geq 2$ and N is a natural number). The N sensors can be counted individually, for example. The counting order can be implemented, for example, such that after the start of the movement of a movement element in the opened state of the movement element, the sensors are counted in the order in which they are successively passed by the movement element.

In one advantageous embodiment of the invention, the n-th sensor (where $n=1, 2, \ldots N$ and where n, N: natural numbers) is then assigned a result value which can be described as a function of n, provided that the n-th sensor detects something. Otherwise, a sensor that detects nothing is assigned the value zero. It is conceivable, for example, to assign the numerical value $\mathbf{2}^{n-1}$ to the n-th sensor. It is particularly advantageous to choose an exponential function because a continuously increasing distance between the numerical values which can be assigned to the individual interrupted light barriers is thereby achieved. If addition is furthermore chosen as the mathematical operation, then this makes it easier to realize a bijective mapping, since the result values deviating from regular operation differ from those of non-regular operation.

It is also conceivable to choose powers to a different base, e.g. to base 3.

The safety of the safety device can be increased, in particular, by the signals and/or result values additionally being assigned a time value corresponding to the instant of the detection. By way of example, the timer can start to run when the movement element is activated. If appropriate, the timer can be stopped when the movement of the movement element is also stopped. Consequently, the timer as it were concomitantly tracks the period of time which has already elapsed during the movement of the movement element. The timer thereby as it were measures the time of the movement of the movement element.

Moreover, it is also conceivable to design the evaluation unit to determine, on the basis of the time determined by the timer, a desired position of the movement element, at which the movement element should be situated during regular operation. This information can be adjusted for example with the information of which light barriers are or are not actually interrupted. By way of example, if a light barrier is interrupted which cannot yet have been passed at all by the movement element, then the detected article can only be an object, rather than the movement element. Therefore, a risk of collision exists. A switch-off signal is then generated. The evaluation unit can be designed to determine, on the basis of the desired position, which sensors should be interrupted and free again on account of the movement of the movement element, and accordingly calculate by means of the mathematical operation a desired value which would result from the signals of the sensors passed during regular operation. Accordingly, in one advantageous development of the invention, the evaluation unit is designed to compare the result value with the desired value. Accordingly, it can be particularly advantageous to design the evaluation unit such that the desired position is taken as a basis for determining which sensors should have detected the movement element on account of the movement of the movement element. By means of the mathematical operation, a desired value is calculated which would result from the signals of the light barriers interrupted during regular operation, if e.g. light barriers are present as sensors. The evaluation unit can therefore be designed, for example, to carry out a cross-check. On account of the time—determined by the timer—which has elapsed during the movement of the movement element, for example a certain number of light barriers should already have been passed and thus interrupted. Furthermore, a specific result value should therefore be present, a so-called desired value. The desired value is compared with the result value actually determined. If the values do not correspond, then regular operation is not present. If appropriate, the movement element has to be stopped. It is conceivable, for example, for an object to be detected by a light barrier and for a deviation in the result value from the desired value therefore to arise. In principle, therefore, it is also possible to detect whether some other disturbance is present. By way of example, it might be the case that the speed of the movement element does not correspond to the speed required during regular operation. Consequently, the movement element has passed too few or too many light barriers. If appropriate, in this case, the movement element can also be stopped by means of a corresponding switch-off signal.

It is furthermore conceivable to concomitantly take account of a certain tolerance in connection with such a desired value. The speed of the movement element is regularly also known only within a certain tolerance range. Therefore, it can happen that even during regular operation taking account of these tolerances a sensor is actually passed or else not passed because the movement element at the greatest speed that can be assumed and can still be afforded tolerance would actually have passed the sensor, while at a speed at the lower tolerance limit the sensor would not yet have been passed or cannot yet detect the movement element since, by way of example, it is still outside the range of the sensor.

Such an embodiment is advantageous particularly when a movement element that performs a telescopic movement is involved. A telescopic movement element has from at least two elements which are guided in parallel rails. In the case of complete opening, the elements are situated at right angles to the closing plane at the edge of the corresponding opening during the closing process or the movement, at least one element is in motion. If the closing process has been concluded, the elements are respectively situated alongside one another. By way of example, the individual elements move such that, with the door opened, the sensors are initially passed one after the other until approximately half of the door opening has been attained. Afterward, the detection by the sensor passed first ends, and so one sensor after the other is "released" again at certain times in the same order.

In order correspondingly to determine a desired value, it is necessary to obtain a corresponding item of time information. Otherwise, it would be possible to explain only by a risk of collision or a disturbance case why the light barriers initially passed are open again and, for example, only sensors in the center of the door opening indicate a detection. This case must then be interpreted as regular operation and not as a case of disturbance. In principle, it is therefore conceivable that two different cases can occur in which, however, the sensors detect or do not detect something in the same way. In one case, by way of example, a case of disturbance can be present (e.g.: door in the upper region has left the guide), while in the other case regular operation is present (e.g.: upper light barrier in the case of a telescopic door no longer interrupted after a certain time).

The sensors can be embodied as light barriers, for example. However, it is also conceivable to use a time-of-flight (abbreviation: TOF) sensor. A TOF sensor advantageously additionally makes it possible, in principle, to effect a distance or position determination of a detected object. However, it is conceivable to use the TOF sensor in such a way that only the information of whether something is actually detected or not is obtained.

In one preferred development of the invention, the sensors can be arranged parallel to the direction of movement of the movement element, furthermore in particular such that they lie in the movement plane of the movement element. The parallel arrangement along the direction of movement makes it possible for one sensor after the other successively to be able to detect the moving movement element. The arrangement in the movement plane makes it possible for the movement space in which there could be a risk of collision to be monitored as completely as possible.

The sensors can furthermore be arranged perpendicularly to the direction of movement, in order e.g. to uniformly scan the movement space.

The evaluation unit can also be designed to interrupt the movement of the movement element. By way of example, a corresponding switching unit, a contactor or a relay or the like can be integrated into the evaluation unit. It is conceivable to integrate the open-loop and/or closed-loop control of the movement element into the evaluation unit to form a unit that is as compact as possible. The evaluation unit can therefore also be designed as a supervisory unit for supervision, i.e. for open-loop and/or closed-loop control, of the movement of the movement element. Inter alia, the supervisory unit can also be designed to receive a user's command to close the door or to interrupt the movement of the door. Such a command can be issued for example via an operating console, a remote control, if appropriate acoustically or in some other way.

In principle, the evaluation unit can acquire the state vectors continuously or repeatedly at time intervals, in particular also periodically.

Furthermore, a closing device comprising a movable, guided movement element and a safety device is accordingly distinguished by the fact that a safety device according to the invention or an exemplary embodiment of the invention is used. In one advantageous development of the invention, the movement element is embodied as a door. At least one of the sensors is arranged in such a way that the movement element can be detected by the sensor.

It is conceivable to retrofit an existing safety device or an existing closing device by merely incorporating an evaluation unit according to the invention for the evaluation of sensors for generating a switch-off signal. The existing safety device or the existing closing device can thus become an embodiment of the invention. If appropriate, the evaluation unit can also be designed as a supervisory unit for supervising the movement of the movement element.

BRIEF DESCRIPTION OF THE DRAWINGS

An exemplary embodiment of the invention is illustrated in the drawings and is explained in greater detail below with the indication of further details and advantages. In the figures, specifically:

FIG. 2 shows a comparison table for a safety device according to the invention, FIG. 3 shows a comparison table for a safety device according to the invention which takes account of the case of derailing, and FIG. 4 shows a comparison table for a safety device according to the invention which is provided for the case of a telescopic door.

DETAILED DESCRIPTION OF THE INVENTION

Figure 1:
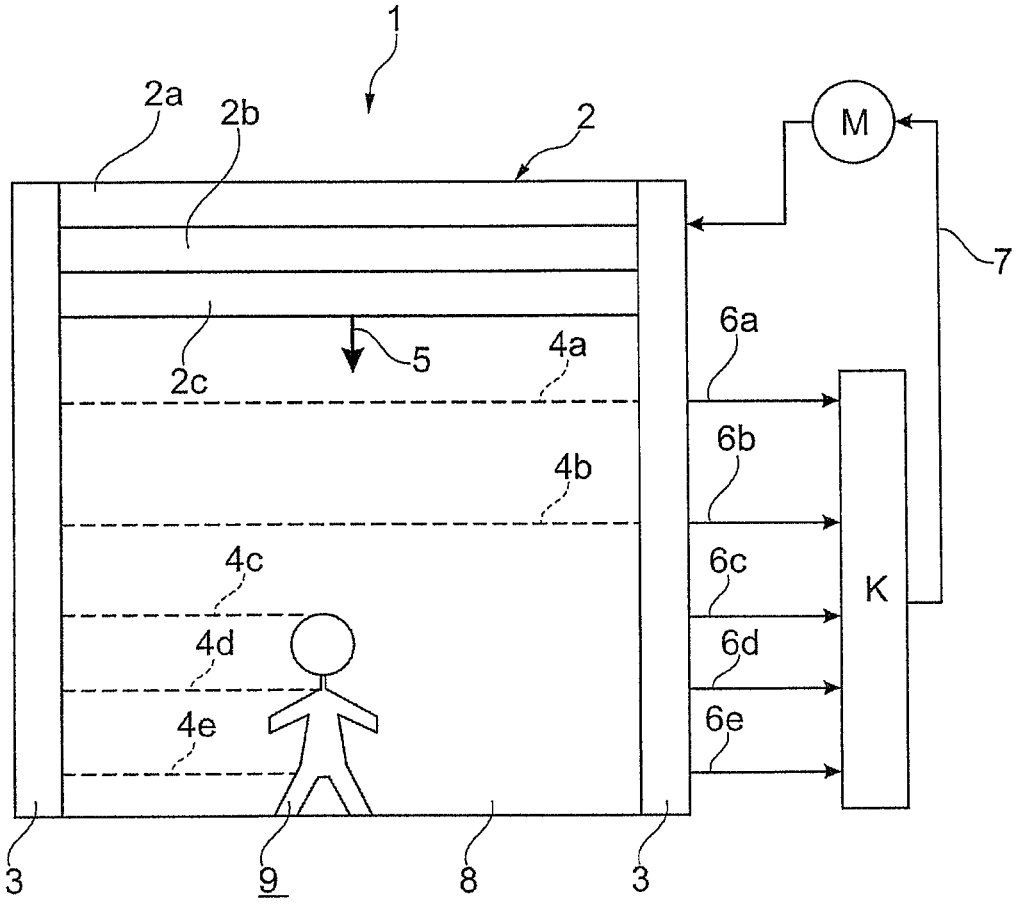
FIG. 1 shows a closing device according to the invention.

FIG. 1 shows a closing device 1 comprising a door 2 consisting of individual door elements 2*a*, 2*b* and 2*c*. The door 2 or the individual elements 2*a*, 2*b*, 2*c* are guided in guide rails 3. Light barriers 4*a*, 4*b*, 4*c*, 4*d*, 4*e* are situated in the guide of the guide rails 3, the individual optical paths of the light barriers being illustrated as dashed lines. In the drawing, the transmitters of the light barriers 4*a* to 4*e*are situated in the left guide rail of the guide 3, and the corresponding receivers are situated in the right guide rail. The direction of movement during the closing of the door 2 is illustrated by an arrow 5. The door 2 is moved by a drive motor M, which is in turn controlled by open-loop or closed-loop control by a supervisory unit K. The individual receivers of the light barriers 4*a* to 4*e* are connected to the supervisory unit K via the corresponding lines 6*a*, 6*b*, 6*c*, 6*d*, 6*e*. The output of the supervisory unit K is in turn connected to the motor M, which is subjected to open-loop or closed-loop control via this output 7.

The closing pane in which the door 2 moves between the two guide rails of the guide 3 is identified by the reference symbol 8. In FIG. 1 a person 9 is currently situated in this plane or in the movement space of the door 2. This person 9 interrupts the light barriers 4*c*, 4*d* and 4*e*. The light barriers 4*a* land 4*b* are not interrupted.

FIG. 2 illustrates a corresponding comparison table. Here six light barriers are present, which are counted by the variable n direction of movement of the door. If the light barrier is not interrupted (identified by the symbol "o" in the column "Status"), each of these light barriers is assigned the value $x_n=0$. If one of the light barriers is interrupted (identified by the symbol " - - - " in the column "Status"), then this interrupted n-th light barrier is assigned the value $x_n=2^{n-1}$, that is to say that the first light barrier is assigned the value 1 in the case of interruption, the second light barrier is assigned the value 2, the third light barrier is assigned the value 4, the fourth light barrier is assigned the value 8, the fifth light barrier is assigned the value 16, and the sixth light barrier is assigned the value 32. If the gate is set in motion in the opened state, then it firstly interrupts the first light barrier, then the second, then the third, etc.

Case I (cf. columns 3-4 in FIG. 2): three light barriers are interrupted; in the present case, the first light barrier is assigned the value 1, the second light barrier is assigned the value 2, the third light barrier is assigned the value 4. The remaining light barriers are respectively assigned the value 0. Since, in the present exemplary embodiment, an addition is provided as mathematical operation, the value 7 arises as the result value (sum) in case I. The comparison table contains the value 7 since the comparison table contains all values which can be formed if in order 1 to a maximum of N light barriers is/are interrupted. The comparison table therefore contains the values 1, 3, 7, 15, 31, 63. The result value 7 means that the first three light barriers are interrupted.

Case II (cf. columns 5-6 in FIG. 2): as a result of a different configuration, in particular a penetrated object, this value cannot arise in principle. Case II shows that the light barriers 1, 2, 3 and 5 are interrupted. This case II cannot correspond to a movement of the door because the door would otherwise have to have, in the region of the fourth light barrier, an interruption which would have to allow the light beam of the light barrier to pass. The interruption of the fifth light barrier is therefore effected by an object which can bring about a collision and, consequently, the supervisory unit must stop the movement of the door. From a mathematical point of view, the result value 23 arises, which is not contained in the comparison table. This value correspondingly leads to an interruption. Since this mapping is advantageously bijective, a corresponding state can unambiguously be assigned to the result values. The supervisory unit can therefore deduce therefrom whether or not an interruption is necessary.

The present exemplary embodiment can be improved again by a timer running as well. By way of example, it might be the case that, in the present example, the door has actually passed the light barriers 1 and 2 and the remaining light barriers should actually be open. However, if an object penetrates into the movement space of the door in such a way that the next, that is to say the third, light barrier is interrupted, then the supervisory unit would accordingly interpret this penetration also as movement of the door, because the value 7 results overall, which is likewise contained in the comparison table. However, if the timer runs as well, then a time correlation can be effected, that is to say that at this point in time of the movement of the door the value 7 cannot yet have been reached, but rather only the value 1+2=3. Accordingly, the supervisory unit can stop the movement of the door.

FIG. 3 shows an exemplary embodiment in which a so-called "blowout effect" takes place. This can be the case particularly with so-called membrane doors. Membrane doors of this type are guided in such a way that, in the event of a corresponding gust of wind or gust that could lead to damage to the door on account of the large force action against the door, that the door slips out of the guide at the corresponding location at which the force action is too large. The force is thereby reduced, and no damage to the door occurs. The present embodiment makes it possible to distinguish whether an object has penetrated into the movement space, or whether such a so-called "blowout effect" has taken place. In this case, the time is concomitantly tracked by a timer. The first two columns of the table show a case in which the door has passed the first three light barriers, to be precise at the instant t−1. As the result value, the value 7 (sum) is correctly indicated at the instant t−1, the value being contained in the comparison table. If the result value still has the value 7 at the instant t, then that means that the door was stopped.

Case I (in FIG. 3): if the door is moved further, then until the instant t it also passes the fourth light barrier and therefore correctly assumes the value 15, which is likewise contained in the comparison table and is also provided for the instant t. The supervisory unit therefore recognizes that the door is moving downward.

Case II (in FIG. 3): in case II, the door has not moved further after passing the third light barrier, rather an object has penetrated that passes the fifth light barrier. If the door had moved further, then the result value 15 should have been expected at the instant t, as already discussed in the first case. As a result of the interruption of the light barrier 5, however, the value 23 (sum) is now present as the result value. The value is greater than the expected result value and therefore means an interruption by an object. The gate must be stopped.

Case III (in FIG. 3): case HI indicates a "blowout" case. The door has moved and in the meantime passed the fourth light barrier. However, the result value is not 15, as would be the case in regular operation, but rather only 13, since a gust of wind has moved the guide in the region of the second light barrier (so-called "blowout"). The light barrier 2 is therefore no longer interrupted. In a case of this type, therefore, an interruption of a light barrier by an object can at least no longer be involved at the instant t. A light barrier is activated again which has already been interrupted by the gate and should therefore still be interrupted, in principle. Therefore, the sum is less than the expected result value, namely the desired value 15.

FIG. 4 shows a table in which a telescopic door performs a movement. In total, eight light barriers are present. Each column shows a different point in time of the movement of the door, to be precise at the successive instants t=1, 2, . . . , 8. The first column (t=1) shows a completely open state. If the door is set in motion, firstly the first light barrier is interrupted (at t=2), the first and second light barriers are interrupted at a later instant t=3, then the first, second and third light barriers are interrupted at t=4, and the first to fourth light barriers are interrupted at t=5. Starting from this instant, although the next, the fifth, light barrier is then also interrupted (t=6), the first light barrier is opened again at t=6, since the corresponding element swings out from the region of the first light barrier. Afterward, in addition to the first light barrier, the second light barrier is also opened in the further course of the movement (t=7). The comparison table is accordingly fashioned such that, depending on the time elapsed during the movement of the door, therefore, firstly, in the case in accordance with FIG. 2, the comparison table can assume the values 0, 1, 3, 7 and 15. Afterward, however, the comparison table does not assume the value 31, but rather the value 30, since the first light barrier is opened again. The next value is the value 60, since the first and second light barriers are open, that is to say 63−1−2. Accordingly, the next value of the comparison table reads 120. In the case of deviation from these values at the corresponding instants, this means that either an object has penetrated, which is the case when the result values are greater than the desired values of the comparison table at the corresponding instants. In principle, if the time information were not present, a so-called "blowout case" could also be involved if the value is less than the desired value.

LIST OF REFERENCE SYMBOLS

1 Closing device
2 Door
2*a* Door element
2*b* Door element
2*c* Door element
3 Guide
4*a* Light barrier
4*b* Light barrier
4*c* Light barrier
4*d* Light barrier
4*e* Light barrier
5 Direction of movement
6*a* Signal line
6*b* Signal line
6*c* Signal line
6*d* Signal line
6*e* Signal line
7 Control line
8 Movement plane
9 Object/person
K Supervisory unit
M Motor

The invention claimed is:

1. A safety device for safeguarding a movable, guided movement element against undesired collisions with an object situated on a movement path of the movement element, said device comprising: a plurality of sensors for detecting the object and the movement element and for outputting signals depending on the detection, and an evaluation unit for evaluating the signals from the plurality of sensors and for generating a switch-off signal on the basis of the evaluation, wherein the evaluation unit checks, independent of a position of the movement element, the output signals of each of the plurality of sensors, to acquire a currently detected state vector, the currently detected state vector being one state vector from a set of state vectors which unambiguously comprise all possible combinations of the signals of all of the plurality of sensors, and generates the switch-off signal only when the currently detected state vector is one of one or more predetermined state vectors from the set of state vectors, wherein when an object is detected, the evaluation unit evaluates the currently detected state vector to distinguish whether the movement clement has been detected or the object with a risk of collision.

2. The safety device as claimed in claim 1, wherein the evaluation unit assigns, by means of a bijective mapping, unambiguously exactly one item of state information from a predetermined target set to each state vector from a set of state vectors which comprise the signals of the respective sensors individually depending on the position thereof, and generates the switch-off signal in the case of predetermined items of state information.

3. The safety device as claimed in claim 1, wherein the evaluation unit:

assigns to the sensors in each case a numerical value depending on the position thereof and on the signal thereof and to assemble the state vector from these numerical values, and carries out the bijective mapping as a mathematical operation of the numerical values such that a corresponding result value is obtained as state information, said safety device further comprising a storage unit in which a comparison table with comparison numbers corresponding to the predetermined state vectors is stored, and wherein the evaluation unit compares the result value determined with the comparison numbers of the comparison table and generates the switch-off signal depending on this comparison, wherein the evaluation unit is designed to assign the numerical value zero to each of the sensors if the sensor is not interrupted, and to carry out the assignment of the numerical value depending on the respective sensor in the case of a total of N sensors, with N being a natural number of at least 2, according to what position the sensor has within the arrangement of the N sensors, wherein the evaluation unit is designed to assign the numerical value $2^{n-1}$ to the n-th sensor within the arrangement of the sensors, n=1, 2. . . N.

4. The safety device as claimed in claim 1, wherein the evaluation unit uses predetermined state vectors and compares a currently detected state vector with the predetermined state vectors and generates the switch-off signal in the case of predetermined state vectors.

5. The safety device as claimed in claim 1, wherein the evaluation unit at least temporarily stores at least one state vector acquired before the currently detected state vector and compares it with the currently detected state vector.

6. The safety device as claimed in claim 1, further comprising a timer, which is activated with the commencement of the movement of the movement element and stopped when the movement of the movement element stops, wherein the timer communicates a time value to the evaluation unit.

7. The safety device as claimed in claim 6, wherein the evaluation unit determines the state vectors predetermined for the generation of the switch-off signal on he basis of the time value.

8. The safety device as claimed in claim 1, wherein the evaluation unit additionally assigns to at least one of the signals and to a result values a time value corresponding to the instant of the detection, wherein the evaluation unit comprises a timer, which is activated with the commencement of the movement of the movement element and stopped when the movement of the movement element stops, such that the timer measures the already elapsed time of the movement of the movement element, and wherein the evaluation unit calculates on the basis of the time value a desired value which would result from the signals of the sensors interrupted during regular operation, and also compares the result value with the desired value and generates the switch-off signal depending on this.

9. The safety device as claimed in claim 1, wherein the sensor is a radiation barrier.

10. The safety device as claimed in claim 1, wherein the sensors are arranged in at least one position that is parallel to the movement direction of the movement element and in the movement plane of the movement element.

11. The safety device as claimed in claim 1, wherein the sensors are oriented perpendicular to the movement direction of the movement element.

12. The safety device as claimed in claim 1, wherein the evaluation unit interrupts the movement of the movement element when the switch-off signal is present.

13. The safety device as claimed in claim 3, wherein the evaluation unit carries out the comparison with the comparison table repeatedly during the movement of the movement element.

14. A closing device comprising a movable, guided movement element and a safety device as claimed in claim 1, wherein at least one of the sensors is arranged in such a way that it registers the movement element during the movement thereof.

15. An evaluation unit for evaluating sensors of a safety device and for generating a switch-off signal for switching off the drive of the movement element, wherein the evaluation unit and the safety device are as claimed in claim 1.

16. The safety device as claimed in claim 3, wherein the mathematical operation is addition.

17. The safety device as claimed in claim 9, wherein the sensor is one of an interrupted light barrier sensor, a reflected light barrier sensor, and a time-of-flight sensor.

* * * * *